US006270208B1

(12) United States Patent
Ben-Zur

(10) Patent No.: US 6,270,208 B1
(45) Date of Patent: Aug. 7, 2001

(54) INK RESERVOIR

(75) Inventor: Ofer Ben-Zur, Ra'anana (IL)

(73) Assignee: Scitex Vision Ltd., Herzlia (IL)

( * ) Notice: Subject to any disclaimer, the term of this patent is extended or adjusted under 35 U.S.C. 154(b) by 0 days.

(21) Appl. No.: 09/441,072

(22) Filed: Nov. 16, 1999

(51) Int. Cl.[7] ..... B41J 2/175
(52) U.S. Cl. ..... 347/86; 347/86
(58) Field of Search ..... 347/84, 85, 86, 347/87

(56) References Cited

U.S. PATENT DOCUMENTS 5,912,689 6/1999 Ostuka et al. ..... 347/86

FOREIGN PATENT DOCUMENTS 63-295270A * 12/1988 (JP) ..... B41J/3/04

* cited by examiner

*Primary Examiner*—N. Le
*Assistant Examiner*—Anh T. N. Vo
(74) *Attorney, Agent, or Firm*—Mark M. Friedman

(57) ABSTRACT

An ink reservoir, for supplying ink to at least one inkjet print head, containing partitions which divide the volume of ink in the reservoir into sub-volumes, which significantly reduce, or eliminate, pressure fluctuations which arise as a result of acceleration of the ink reservoir. Each sub-volume is connected to adjacent sub-volumes via pressure equilibration passages. Lower pressure equilibration passages ensure equal ink height within all sub-volumes, following the discharge of ink from supply outlets and upper pressure equilibration passages ensure equal air pressure above all sub-volumes. A further as aspect involves a reservoir supplying print heads where planes, substantially perpendicular to the primary direction of motion, intersect corresponding reservoir supply outlets and print head supply inlets in order to eliminate supply line pressure fluctuations. A combination of the two aspects eliminate both reservoir and supply line pressure fluctuations.

3 Claims, 5 Drawing Sheets

Section A-A

INK RESERVOIR

FIELD AND BACKGROUND OF THE INVENTION

The present invention relates to ink supply for inkjet printers and, in particular, it concerns the subdivision of the volume of an ink supply reservoir into two or more interconnected sub-volumes, to alleviate pressure fluctuations caused by acceleration of the reservoir.

It is known to employ an arrangement of one or more inkjet print heads in a scanning motion to achieve full print coverage across the length and width of a substrate. For certain applications, it is important to minimize the size and weight of the moving components and consequently, ink is supplied to the print head from a stationary ink reservoir. However, for other applications this is impractical, and the print head and reservoir move together on a print head assembly and hence execute the same motion. In order to achieve rapid printing, large velocities over short distances, and therefore large accelerations, are required of the print head and reservoir.

FIG. 1 shows a cross-sectional side view of a typical reservoir 600 and indicates a container which is composed of walls, including side walls 601, a base 602 containing supply outlets 603, and a lid 604 containing an atmosphere communication opening 605, which together define a contained volume 608. If the reservoir is accelerated in the primary direction of motion 609, i.e. to the right, this results in a gradient of the ink level 607 where the magnitude of the gradient is proportional to the magnitude of the acceleration. Clearly, a similar, but opposite, situation would arise if the acceleration was in the opposite direction, i.e. to the left.

The liquid ink gradient induces a pressure gradient across the base of the reservoir, where the pressure above each ink supply outlet 603, is proportional to the height of liquid ink above it. Furthermore, when reservoir 600 stops accelerating, gravity causes ink level 607 to tend towards the horizontal, thereby causing fluctuations in ink level 607. Fluctuations of ink level 607 are highly undesirable for two main reasons. Firstly, effective operation of the print head (not shown) relies on a small and constant pressure differential between the print head and reservoir 600. Small pressure fluctuations, on the order of millimeters of ink, between the print head and reservoir 600 can dramatically degrade the print quality. Secondly, if ink level 607 fluctuations become excessive, and the resulting pressure fluctuations exceed some threshold, this can result in total cessation of printing.

Another problem associated with acceleration is the inertial force acting on the liquid ink within the tubes, making up supply lines, connecting a print head and reservoir which are not aligned on the same plane normal to the direction of the acceleration. This scenario is depicted schematically in FIG. 2, which shows a top view of a print head assembly 509. Print head assembly 509 is made up of an ink reservoir 500, a print head 502 and a rigid plate 506. Ink reservoir 500 and print head 502 are mounted rigidly on rigid plate 506. Print head assembly 509 accelerates in a primary direction of motion 507. A supply line 501, from a supply outlet 503 of reservoir 500, supplies ink to print head 502 via a print head supply inlet 505. The distance between supply outlet 503 and supply inlet 505, parallel to primary direction of motion 507, is indicated 504. When print head assembly 509 accelerates, an inertial force acts on the ink within supply line 501 which is proportional to length 504. The inertial force in the supply line 501 causes a pressure fluctuation in print head 502 that is proportional to length 504. Much like the example presented in FIG. 1, pressure fluctuations of this nature can be severe enough to dramatically reduce print quality or even bring about cessation of printing.

There is therefore a need for an ink reservoir for supplying ink to an inkjet print head which will overcome the aforementioned problem of pressure fluctuations. Specifically, there is a need to eliminate or significantly reduce reservoir ink level fluctuations which arise during print head assembly accelerations. Associated with this problem, there is a need to eliminate pressure fluctuations resulting from inertial forces acing on ink in supply lines during print head assembly accelerations.

SUMMARY OF THE INVENTION

The present invention is an ink reservoir, for inclusion in a moving inkjet print head assembly, and for connection, via an ink supply line, to at least one inkjet print head.

According to the teachings of the present invention there is provided, an ink reservoir, for inclusion in a moving inkjet print head assembly, and for connection, via an ink supply line, to supply ink to at least one inkjet print head. The ink reservoir comprises a container, formed from at least one wall and configured so as to define a contained volume for receiving ink, and at least one supply outlet being formed in the wall. Partitions are deployed so as to subdivide the contained volume into sub-volumes and pressure equilibration passages interconnect between the sub-volumes. The cross-sectional area of each pressure equilibration passage is less than about 10% of the area of each partition.

According to an alternative, or additional, aspect of the present invention there is provided an inkjet printer comprising a moving inkjet print head assembly, which includes an ink reservoir with supply outlets and print heads with supply inlets. The print head assembly is driven in a primary direction of motion such that planes substantially perpendicular to the primary direction of motion intersect corresponding reservoir supply outlets and print head supply inlets. The supply inlets may be displaced relative to one another in a direction having a non-zero component along the primary direction of motion.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an ink supply reservoir, which is subdivided into distinct, but interconnected sub-volumes, which significantly reduce, or even eliminate, ink pressure fluctuations during reservoir and print head accelerations. The present invention further provides an ink supply reservoir, for inclusion in a print head assembly, in a manner that it can supply multiple print heads while eliminating pressure fluctuations set up in the ink supply lines.

The principles and operation of ink reservoirs according to the present invention may be better understood with reference to the drawings and the accompanying description.

Figure 1:
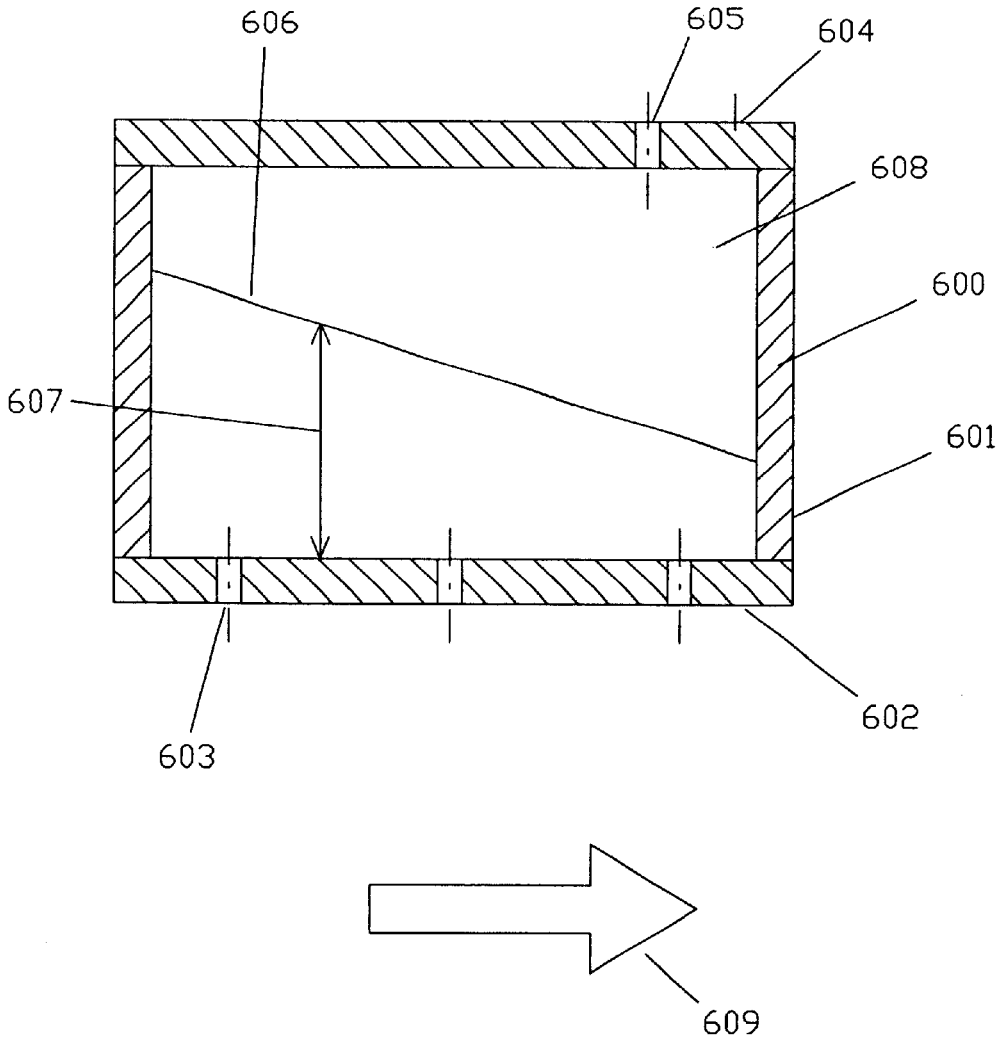
Fig. 1. Prior Art
FIG. 1 is a cross-sectional side view of a typical ink reservoir (prior art)
Figure 2:
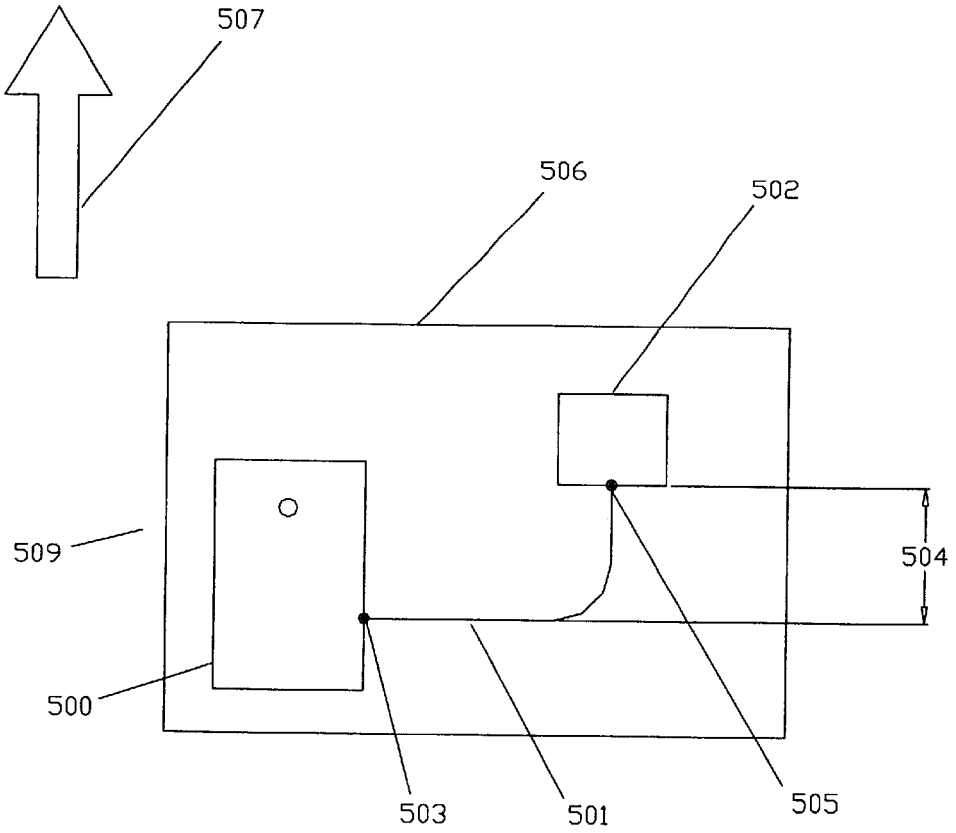
Fig. 2. Prior Art
FIG. 2 is a top view of a print head assembly (prior art)

Before addressing the specific features of the present invention in detail, it is pointed out that there are two aspects to the present invention. The first aspect deals with the reservoir as a stand-alone invention and describes how ink-level fluctuations, described in FIG. 1, are reduced or eliminated (see FIGS. 3 and 4 with the accompanying description below). The second aspect deals with a reservoir as part of a print head assembly and addresses the problem of ink supply line pressure fluctuations described in FIG. 2 (see FIG. 5 and the accompanying description below). While each aspect Ray be used alone to good effect, a combination of the two aspects serves the dual purpose of reducing or eliminating ink-level fluctuations in the reservoir and substantially eliminating pressure fluctuations in ink supply lines.

Figure 3:
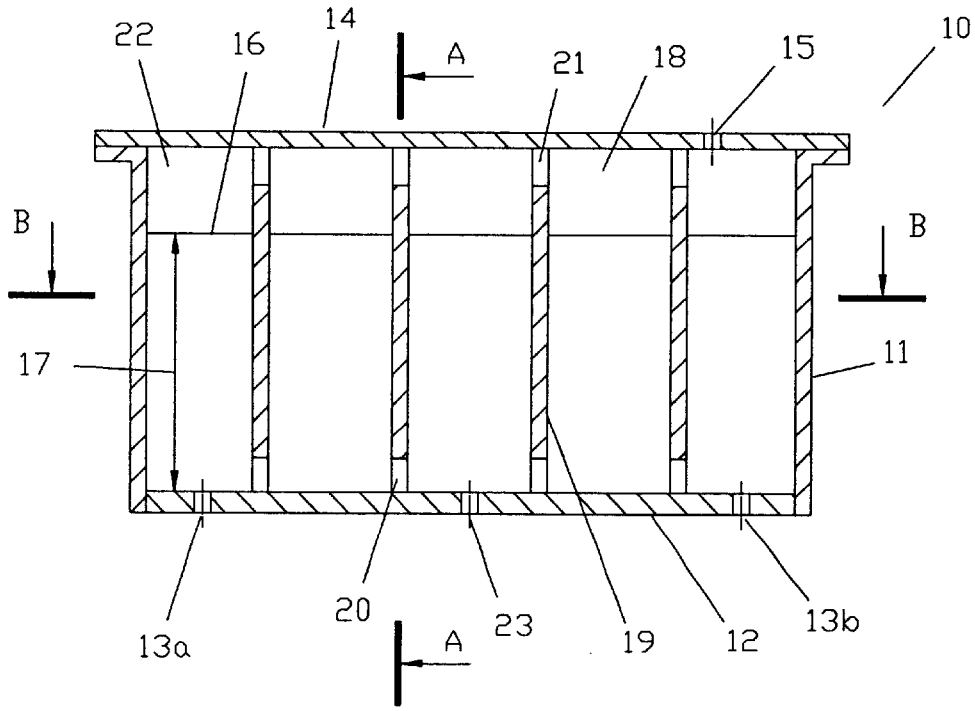
FIG. 3 is a schematic cross-section side-view of an ink reservoir, constructed and operative according to the teachings of the present invention.

Referring now to the drawings, FIG. 3 shows an ink reservoir, generally designated 10, constructed and operative according to the teachings of the present invention. Ink reservoir 10, is configured for connection to a number of ink supply lines via a number of supply outlets 13*a* and 13*b*. Ink reservoir 10 may contain more than two supply outlets. Only two supply outlets 13*a* and 13*b* are depicted in FIG. 3 for illustrative purposes.

Generally speaking, ink reservoir 10 is a container which is composed of walls, including side walls 11, a base 12 and a lid 14, which together define a contained volume 18. Ink reservoir 10 further contains the above-mentioned supply outlets 13*a* and 13*b*, a supply inlet 23 and a lid 14 that contains an atmosphere communication opening 15.

Contained volume 18 is subdivided, by one or more partitions 19, into two or more sub-volumes 22. Each partition 19 is equipped with a lower pressure equilibration passage 20, which allows liquid ink 16 to flow between adjacent sub-volumes 22 and thereby maintain a constant ink height 17 within each sub-volume and consequently above each supply outlet 13*a* and 13*b*. Furthermore, each partition 19 is equipped with an upper pressure equilibration passage 21, which allows air flow between adjacent sub-volumes 22, thereby maintaining constant air pressure above the ink in each sub-volume.

Figure 4:
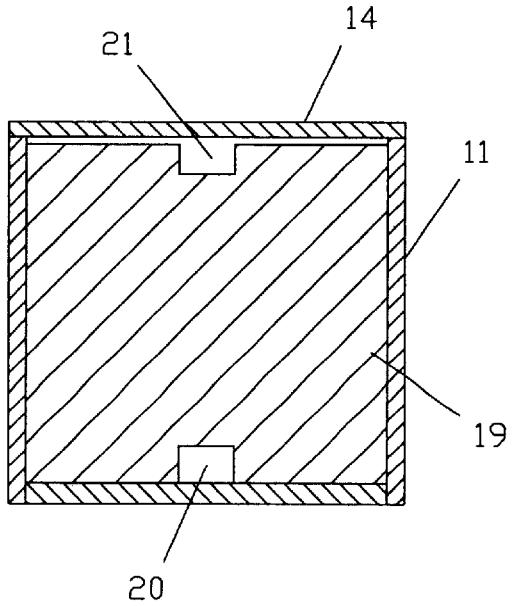
FIG. 4 is a schematic cross-section through a partition within the ink reservoir.

FIG. 4 shows a cross-section A-A through one of the partitions 19 in reservoir 10. The figure illustrates, in more detail, the approximate location and shape of lower pressure equilibration passage 20, and the upper pressure equilibration passage 21. The cross-sectional area of each pressure equilibration passage is preferably less than about 10% of the area of each partition.

It will be readily apparent that ink reservoir 10 provides a very simple and cost-effective solution to the aforementioned problem of pressure fluctuations resulting from large transverse acceleration of ink reservoir 10. Specifically, partitions 19 eliminate the large ink gradient, and consequently, the large pressure gradient across reservoir base 12, and only small local ink gradients exists within each sub-volume 22. Consequently, only small pressure fluctuations exist across reservoir base 12. Moreover, the pressure on base 12 at the center of each sub-volume 22 is identical and this entirely eliminates pressure fluctuation.

Supply outlets, such as 13*a* and 13*b*, may not be located within each sub-volume. Furthermore, in general, different supply outlets discharge ink at different discharge rates and at different times. Therefore, a pressure differential may arise as a result of an ink height difference between adjacent sub-volumes. In such an instance, the pressure differential between adjacent sub-volumes drives the ink from reservoirs which have a higher ink level to the reservoir that has a lower ink level, via lower pressure equilibrium passages 20, while concomitantly air pressure is equilibrated by air flow through upper pressure equilibration passages 21. In this manner a constant ink height, and consequently a constant pressure, is maintained at supply outlets such as 13*a* and 13*b*.

Figure 5:
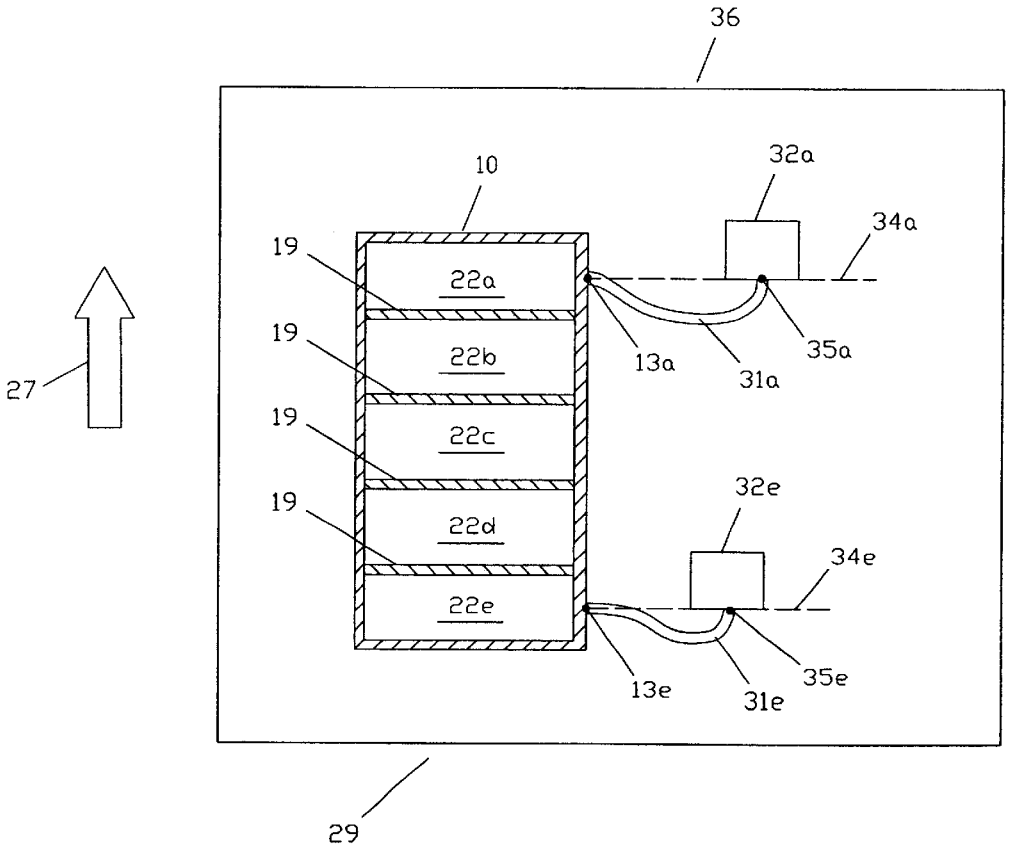
FIG. 5 is a top view of a print head assembly, with a cross-section of the ink reservoir, constructed and operative according to the teachings of the present invention.
Figure 6:
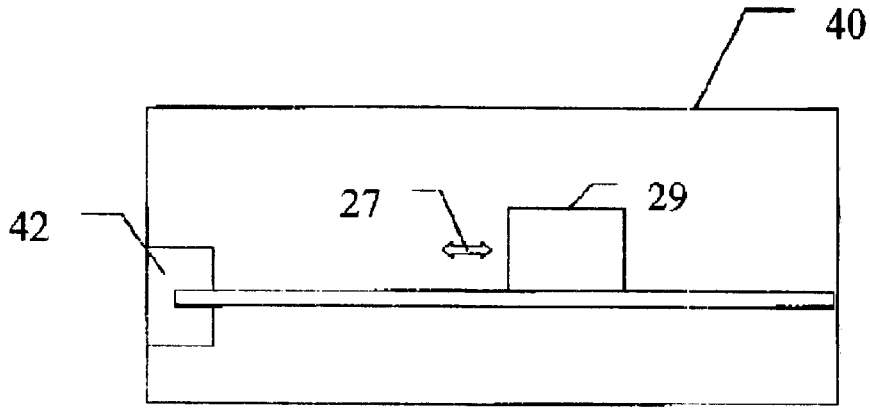
FIG. 6 shows a schematic top view of an ink-jet printer including the print head assembly of FIG. 5.

FIG. 5 shows a top view of a print head assembly 29, which includes an ink reservoir 10 as described in FIG. 3, a first print head 32*a*, a second print head 32*e* and a rigid plate 36. A top-view cross-section B—B (see FIG. 3), of ink reservoir 10, reveals partitions 19 and sub-volumes 22*a* through 22*e*. Ink reservoir 10 and print heads 32*a* and 32*e*, are mounted rigidly on rigid plate 36 and are connected by supply lines 31*a* and 31*e*, respectively. Ink reservoir 10 supplies ink, via supply lines 31*a* and 31*e*, through supply outlets 13*a* and 13*e*, to print heads 32*a* and 32*e*, through supply inlets 35*a* and 35*e*, respectively. FIG. 6 shows an inkjet printer 40 including print head assembly 29. A drive system (numeral 42) is configured to move print head assembly 29 in a primary direction of motion 27.

Of importance to the correct operation of the arrangement presented in FIG. 5, a first plane 34*a* and a second plane 34*e*, which are both substantially perpendicular to primary direction of motion 27, must intersect supply outlets 13*a* and 13*e* and supply inlets 35*a* and 35*e*, respectively. The figure depicts a single print head, either 32*a* or 32*e*, connected to each sub-volume, either 22*a* or 22*e*, but this is for purposes of illustration only because any number of print heads can be connected to a sub-volume, within the practical limitations of the design. Moreover, additional print heads may be connected to any of the sub-volumes, 22*a* through 22*e*, provided that a plane, which is substantially perpendicular to primary direction of motion 27, intersects corresponding reservoir supply outlets print head supply inlets.

It will be readily appreciated that when print head assembly 29 accelerates in primary direction of motion 27, the force acting on ink in supply lines during print head assembly accelerations are substantially reduced or eliminated. This is due to the elimination of distance 504 (in FIG. 2), parallel to primary direction of motion 27, between supply outlets 13*a* and 13*e*, and supply inlets 35*a* and 35*e*, respectively. With distance 504 equal to zero, the net inertial force on ink within supply lines 31*a* and 31*e*, is also equal to zero. This effectively eliminates or substantially reduces supply line pressure fluctuations.

It should be noted that the elimination of supply line pressure fluctuations in this manner is not necessarily dependent upon the specific reservoir used on print head assembly 29. For example, if reservoir fluctuations are not severe enough to affect print quality, then the alignment of supply outlets 13*a* and 13e with supply inlets 35*a* and 35*e* still constitutes and effective method for eliminating supply line pressure fluctuations.

It is readily apparent from the description of print head assembly 29, on the other hand, that most preferred implementations of ink reservoir 10 provide the solution to two problems simultaneously. On the one hand ink level fluctuations, and hence pressure fluctuations, are significantly attenuated or even completely eliminated as a result of the reservoir design. On the other hand, the reservoir design facilitates its inclusion in a print head assembly in a manner that it can supply multiple print heads while eliminating the forces, and hence pressure fluctuations, set up in the supply lines.

It will be appreciated that the above descriptions are intended only to serve as examples, and that many other embodiments are possible within the spirit and the scope of the present invention.

What is claimed is:

1. An inkjet printer comprising:

(a) a moving inkjet print head assembly including:

(i) an inkjet reservoir having at least a first supply outlet and a second supply outlet, (ii) at least two print heads, each of said print heads having a supply inlet, (iii) a first supply line connecting between said first supply outlet and said supply inlet of a first of said at least two print heads, and (iv) a second supply line connecting between said second supply outlet and said supply inlet of a second of said at least two print heads;

(b) a drive system configured to a move said print head assembly in a primary direction of motion, wherein said second supply inlet is displaced relative to said first supply inlet in a direction having a non-zero component along said primary direction of motion, and wherein a first plane substantially perpendicular to said primary direction of motion passing through said supply inlet of said first print head intersect said first supply outlet and a second plane substantially perpendicular to said primary direction of motion passing through said supply inlet of said second print head intersects said second supply outlet.

2. The inkjet printer of claim 1, wherein said ink reservoir includes:

(a) a container, formed from at least one wall, configured so as to define a contained volume for receiving ink; and (b) at least one portion deployed so as to subdivide said contained volume into at least two sub-volumes interconnected by at least one pressure equilibration passage, wherein said first and second supply outlets are supplied from different of said sub-volumes.

3. The inkjet printer of claim 2, wherein a cross-sectional area of said at least one pressure equilibration passage is less than about 10% of a surface area of one side of said at least one patrition.

* * * * *

UNITED STATES PATENT AND TRADEMARK OFFICE

CERTIFICATE OF CORRECTION

PATENT NO. : 6,270,208 B1
DATED : August 7, 2001
INVENTOR(S) : Ofer Ben-Zur

It is certified that error appears in the above-identified patent and that said Letters Patent is hereby corrected as shown below:

Column 2,
Line 59, the word "and," should follow the last word on this line "invention;"

Column 4,
Line 27, the word "numeral" which precedes the no. 42 is not required.

Signed and Sealed this

Twenty-second Day of October, 2002

*Attest:*

*Attesting Officer*

JAMES E. ROGAN
*Director of the United States Patent and Trademark Office*